United States Patent [19]

Reiland

[11] 3,965,507

[45] June 29, 1976

[54] ATHLETE'S LANDING PIT CUSHION

[75] Inventor: Harold P. Reiland, Wichita, Kans.

[73] Assignee: The Langdon Corporation, Wichita, Kans.

[22] Filed: Feb. 3, 1975

[21] Appl. No.: 546,268

[52] U.S. Cl. ..... 272/104; 5/367

[51] Int. Cl.[2] ..... A47C 27/08

[58] Field of Search ..... 5/344, 345, 348 R, 349, 5/350; 182/137, 139; 272/57, 60

[56] References Cited

UNITED STATES PATENTS

| | | | |
|---|---|---|---|
| 1,673,636 | 6/1928 | Perry | 5/350 |
| 3,391,414 | 7/1968 | Gordon | 5/348 R |
| 3,399,407 | 9/1968 | Olsen | 5/348 R |

*Primary Examiner*—Paul R. Gilliam
*Assistant Examiner*—Andrew M. Calvert
*Attorney, Agent, or Firm*—John H. Widdowson

[57] ABSTRACT

An athlete's landing pit cushion has an upright notch in an edge portion thereof. The notch sidewall is inclined upwardly and outwardly relative the vertical. The landing cushion can be used as a pole vault landing cushion, the notch being placed at the pole resting end portion of a pole vault box or the like.

5 Claims, 4 Drawing Figures

ATHLETE'S LANDING PIT CUSHION

BACKGROUND OF THE INVENTION

This invention is related to athlete's landing cushions. More specifically, this invention is related to athlete's landing cushions used for pole vaulting wherein the cushion is constructed with a notch in the forward portion of the cushion.

Numerous types of athlete's landing cushions are known in the prior art to cushion the fall of athletes in sports such as high jumping, pole vaulting and others. The landing cushions used heretofore for pole vaulting are provided with a notch in a forward edge portion of the cushion structure to fit around the pole receiving end portion of the pole vault box. The pole vault box is normally mounted in the ground and the notched portion of the landing cushion is positioned in a spaced relation around the deepest end portion of the pole vault box. These prior art landing cushions have a notch with vertically upright sidewalls extending from the ground to the top of the cushion. When a pole vaulter makes a vault the pole rests in the deepest end portion of the pole vault box and the mid portion of the pole bends considerably as the athlete rises through the air at the beginning of the jump. In using the described prior art landing cushions with the notches having the vertically disposed sidewalls, it is a common occurrence that the lower portion of the pole will strike the sidewall of the notch, thus, interfering with the athlete's performance. Although contact of the pole and the sidewall of the cushion may only be minimal in terms of force it has been found significant enough to substantially effect a pole vaulter's performance. Additionally, because of the fact that with these prior art devices the pole might strike the landing cushions in the notch area it creates a psychological impairment on the athlete's preparedness for the jump which can be detrimental to his performance.

No athlete's landing cushions are known in the prior art that have a notch structure in the forward portion of the cushion which is constructed so that it will not interfere with a pole vaulter's pole when making a jump.

SUMMARY OF THE INVENTION

In a preferred specific embodiment, an athlete's landing cushion includes a cushion unit having an upright notch portion in an edge portion thereof. The notch is constructed with a side that is inclined upwardly and outwardly relative the vertical direction with the upper portion thereof displaced toward the center portion of the cushion unit from the lower portion thereof. The notch portion is constructed with the length of its upper edge portion being substantially larger than the length of its lower edge portion. The landing cushion unit of this invention is constructed and adapted to be used with a pole vault pit or the like where the notch is placed adjacent to the pole resting end portion of the pole vault box or the like.

One object of this invention is to provide an athlete's landing cushion structure overcoming the aforementioned disadvantages of the prior art devices.

Still, one other object of this invention is to provide an athlete's landing cushion structure which has a cushion unit with an upright notch in an edge portion thereof, wherein the closed portion of the notch has a sidewall inclined relative the vertical so its upper end portion is displaced toward the center of the cushion unit.

Still, another object of this invention is to provide an athlete's landing cushion structure which has a notch portion in the forward edge portion thereof which in use is positioned adjacent to a pole vault box, wherein the notch is tapered so that a pole vaulter's pole will not strike the landing cushion when an athlete is executing a pole vault jump.

Yet, another object of this invention is to provide an athlete's landing cushion structure which has a generally trapezoidally shaped notch portion in a forward portion thereof.

Various other objects, advantages, and features of the invention will become apparent to those skilled in the art from the following discussion, taken in conjunction with the accompanying drawing, in which:

Figure 1:
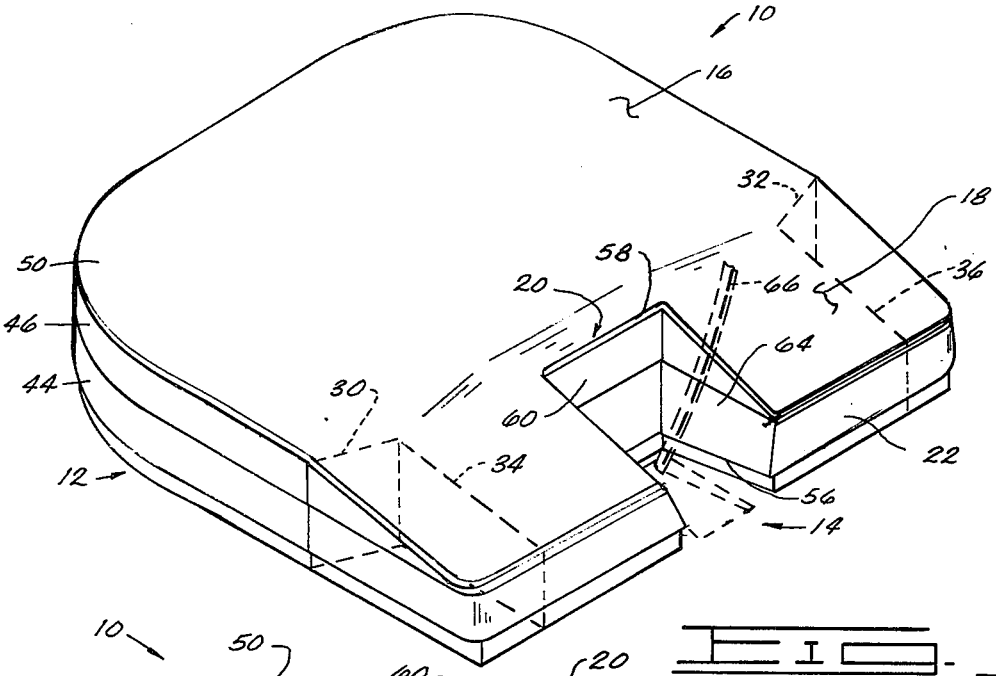
FIG. 1 is a perspective view of the landing cushion of this invention taken from above the forward end portion thereof. Dashed lines illustrate optional constructions of the cushion sides on the forward end portion and a pole vault box, and the lower end portion of a pole.

The following is a discussion and description of preferred specific embodiments of the athlete's landing pit cushion of this invention, such being made with reference to the drawings, whereupon the same reference numerals are used to indicate the same or similar parts and/or structure. It is to be understood that such discussion and description is not to unduly limit the scope of the invention.

DESCRIPTION OF PREFERRED EMBODIMENT

Referring to the drawing in detail and in particular to FIG. 1, the athlete's landing cushion of this invention, indicated generally at 10, is shown on a supporting structure 12 and positioned adjacent to a pole vault box 14. The cushion structure includes a large center portion 16 and a forward portion 18. The forward portion 18 is constructed with a notch, indicated generally at 20, opening to the forward side 22.

Figure 2:
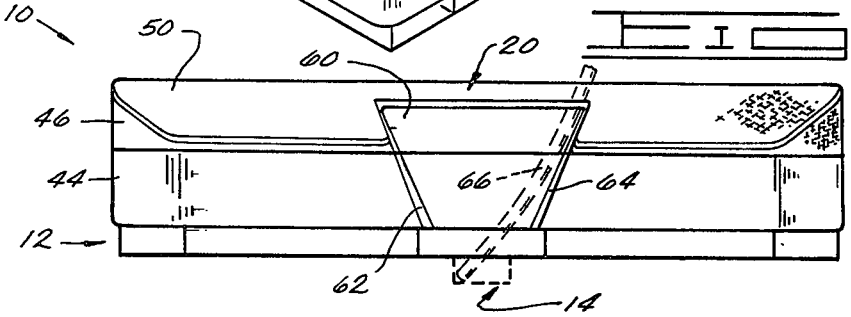
FIG. 2 is a forward end elevation view of the landing cushion of this invention resting on a support member. Dashed lines indicate a pole vault box and the lower end portion of a pole in a bent position.
Figure 3:
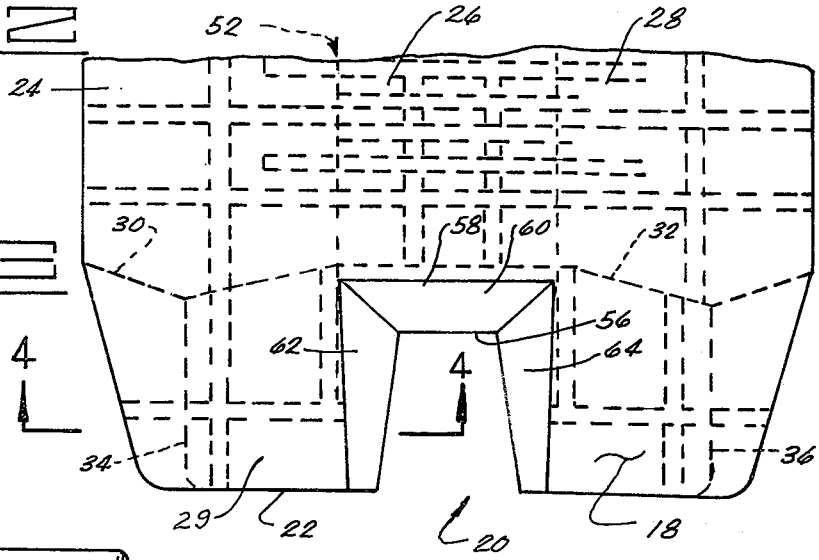
FIG. 3 is a top plan view of the forward portion of the landing cushion of this invention. Dashed lines illustrate optional constructions for the sides of the forward end portion, separable segments of the cushion structure, and air vent passageways through the cushion segments.
Figure 4:
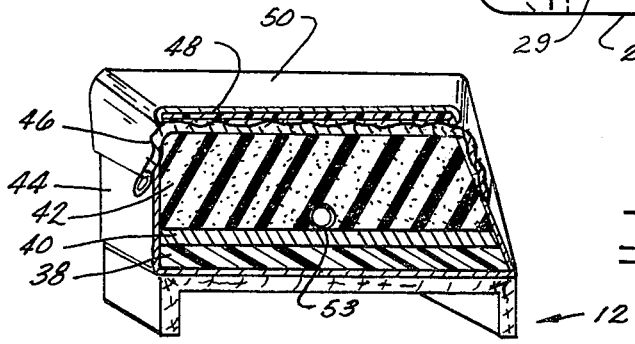
FIG. 4 is a cross sectional view of the forward end portion of the landing cushion of this invention taken on line 4–4 of FIG. 3.

The landing cushion 10 is constructed fo four segments which are constructed separately and joined together in the finished structure as shown in FIG. 1. The main portion of the cushion is comprised of three segments as illustrated in FIG. 3, with the segments being indicated at 24, 26, and 28. The three segments 24, 26, and 28 are approximately the same size and fit together as shown. A forward cushion segment 29 fits against the end of the other cushion segments. Cushion segments 24 and 28 have a pointed forward end portion as shown by the dashed lines in FIG. 3 and indicated at 30 and 32, respectively. As shown in FIGS. 1, 2, and 4 the forward cushion segment 29 is inclined horizontally downward toward the front edge 22. The forward cushion segment 29 can be constructed of a width sufficient to span the entire end of the three other cushion segments as shown by the solid lines in FIG. 3, or it can be constructed in a narrower configuration as shown by the dashed lines 34 and 36 in FIG. 1 and in FIG. 3. The narrower configuration of the front portion 18 allows the landing cushion 10 to have the forward portion placed between the uprights of many existing pole vault installations. The wider configuration of the landing cushion's front portion 18 also can be positioned between the uprights in a pole vault installation where the uprights are spaced farther apart. In some pole vault equipment constructions the uprights are spaced farther apart in order to give the athlete a larger area in which to jump.

Each of the separate segments of the landing cushion 10 of this invention are constructed similarly as shown in FIG. 4. At the bottom of each segment is a layer of substantially rigid foamic material, indicated at 38. Preferably, this layer 38 is a lightweight material. In practice a material commonly sold under the tradename of STYRAFOAM has been successfully used. Immediately above the lowest layer is a layer of intermediate density foam, indicated at 40, which is adhesively secured to the lower rigid layer 38. Immediately above the layer of intermediate density foam 40 is a layer of relatively soft, or low density foam, indicated at 42. The layer of soft foam 42 is adhesively secured to the layer of intermediate density foam 40. In practice an intermediate density foam having a density of approximately 1.5 pounds per cubic foot (24.027 kg/cubic meter) has been used with a low density foam having a density of approximately 1 pound per cubic foot (16.018 kg/cubin meter). The three layers of foam 38, 40, and 42 are wrapped in a protective enclosure which consists of an imperforate portion 44 and a mesh like perforate portion 46. The imperforate portion 44 covers the lower portion of the cushion structure as shown in FIGS. 1 and 4 with the mesh portion 46 covering the upper portion. When an athlete lands on the cushion air is forced through the foam and rushes out of the mesh portion 46. A pad is provided on top of the mesh portion 46 of the cushion's cover. The pad consists of a layer of low density foamic material 48 which is enclosed in a perforate mesh like covering 50. The pad adds additional resiliency to the landing cushion for an athlete and provides a wear surface which protects the cushion covering 46. The pad is completely enclosed in its cover 50 which is secured to the covering 46 of the lower cushion segments by a plurality of common strap and buckle type fasteners at several places around the perimeter of the landing cushions. The fasteners are not shown in the drawing. The interior of the cushion segments are provided with a plurality of interconnecting air passageways through the layer of the low density foam 42. The interconnecting air passageways are shown in dashed lines, indicated generally at 52, in FIG. 3. FIG. 3 shows approximately the forward one half of the landing cushion structure 10, including the air passageways 52. The passageways extend into the rear portion of the landing cushion in a pattern similar to that shown in FIG. 3. The system of air passageways 52 provides for improved air movement within the foam structure of the landing cushion to soften the landing of the athlete.

The landing cushion 10 is shown resting on a support structure 12. The support structure 12 is preferably a wooden platform used to keep the landing cushion off of the ground, thus, preventing damage due to rain, foul weather, etc. It is to be understood that the support structure 12 is not necessary for the operation of the landing cushion of this invention, the support structure merely provides protection for the structure from the weather.

The notch feature of the landing cushion of this invention is shown clearly in FIGS. 1–3. The notch 20 is constructed in the forward portion 18 with the sidewalls thereof being angularly oriented upwardly and outwardly relative the vertical direction and inclined away from the center portion of the notch. In other words, the upper portions of the notch are closer to the side and back edges of the landing cushion than the lower portions of the sidewall. In simpler terms the upper edge portions of the notch 20 are generally closer to the center portion of the cushion unit as a whole than its lower edge portions. The notch 20 is contained in the forward cushion segment 29. Because the forward cushion segment 29 in the cushions forward portion 18 is inclined downward the length of the lower edge portion 56 of the notch is substantially shorter than the length of its upper edge portion 58. Ends of the edge portions 56 and 58 terminate at approximately the same point relative a vertical plane at the forward edge 22. The notch 20 as shown is constructed in a generally trapezoidal shape with three sides being open. Sides of the trapezoidal shape formed by the notch are a back sidewall 60 and opposed sides 62 and 64 with the sides and the back being essentially flat. In regard to the lower edge portion 56 of the notch it is narrower at the back sidewall 60 than at the open portion of the notch along the forward edge 22 of the landing cushion. In regard to the upper edge portion 56 of the notch, it is preferably essentially the same width at the back sidewall 60 as it is at the open portion along the forward edge 22 of the landing cushion. The sides 62 and 64 are spaced so their upper edge portions are essentially equally spaced from a line taken through the center of the notch 20.

In practice, the landing cushion 10 of this invention has been constructed with the notch back 60 being inclined approximately 27° from the vertical and the sides being inclined approximately 24° at their rear portions and 30° at their front portions from the vertical. Inclination in the ranges of 22° to 32°, 19° to 29°, and 25° to 35°, respectively, have been found preferable. In practice and use of the landing cushion 10 of this invention the described notched construction has been found to work very well, because it allows substantial room for a pole vaulter's pole to bend in the generally trapezoidally shaped space defined by the notch 20 without the pole contacting the sides or back of the notch. FIGS. 1 and 2 show the lower end portion of a pole vaulter's pole 66 in the pole vault box 14 with the pole being bent. The pole 66 as shown in FIGS. 1 and 2 is in a position which approximates an extreme bent position because it is close to the notch side 64. The bend of the pole 66 in FIGS. 1 and 2 is exaggerated for illustration purposes. In normal use the pole will usually be spaced slightly more from the sides or the back of the notch 20 than shown thereby eliminating all interference between the pole and the landing cushion.

Although the notch structure 20 is shown in a trapezoidally shaped configuration it is to be understood that it can be constructed with the sidewall thereof having a different shape but retaining an inclined attitude. For example, the sidewall can be constructed in a uniformly curved manner so that the sides and the back merge into a somewhat arch shape or arcuate appearance. Additionally, the sidewall can be constructed with a plurality of surfaces greater than three in the inclined attitude. Also the notch can be constructed having a pair of sides adjoining at an apex, wherein the sides of the sidewall are inclined relative to the vertical disposed direction.

In the manufacture of the athlete's landing cushion of this invention it is obvious that same can be easily constructed to achieve the end product. The landing cushion as descirbed with the trapezoidally shaped notch and the several layers of foamic material has been constructed and used. It is obvious that the landing cushion can be constructed with the notch portion shaped in the alternate constructions as described.

In the use and operation of the athlete's landing cushion of this invention it is seen that it provides a landing cushion specifically adapted for use in pole vaulting wherein it is constructed so the pole will not contact the sides of the cushion in normal use. The novel notch structure with the inclined or tapered sidewall is a unique feature of the landing pit cushion of this invention because it overcomes shortcomings of the prior art devices. In practice, in using the landing cushion of this invention it has been observed that athletes can concentrate more on their jumping efforts because the psychological impairments of the pole striking the cushion is eliminated by the novel notch structure of this invention.

As will become apparent from the foregoing description of the applicant's athlete's landing pit cushion structure, relatively simple and well designed means have been provided to improve the construction of the landing cushion for pole vaulting. The landing cushion structure is simple in construction, attractive in appearance, and provides a useful piece of athletic equipment which increases the safety in the sport of pole vaulting which will not interfere with an athlete's motion and particularly with the pole.

While the invention has been described in conjunction with preferred specific embodiments thereof, it will be understood that this description is intended to illustrate and not limit the scope of the invention, which is defined by the following claims.

I claim:

1. An athlete's landing pit cushion, comprising:

a. a cushion unit having a relatively smooth top portion, a portion of said top portion inclined downwardly; and b. an essentially rectangular upright notch in an edge portion of a side of said cushion unit, said notch portion having opposed sides and a back, said sides and said back inclined upwardly and outwardly relative to the vertical, the upper portion of said notch opening to said inclined top portion of said cushion unit, horizontal lines through the plane of said back of said notch essentially parallel to horizontal lines through the plane of said edge portion of said cushion unit, said sides of said notch divergent from said back toward the edge portion of said cushion unit;

said landing pit cushion is constructed and adapted to be used in a pole vault pit or the like wherein said notch is placed at the pole resting end portion of a pole vault box or the like.

2. The landing cushion of claim 1, wherein:

a. said cushion unit has a main portion and a narrower forward portion extending therefrom, said narrower forward portion being constructed and adapted to in use be positioned between uprights normally used for supporting a pole vault height marking bar transversely above the ground, and b. said narrower forward portion has said notch therein.

3. The landing cushion of claim 1, wherein, said side is inclined relative to the vertical with the upper portion thereof displaced toward the center portion of said cushion unit from said lower portion thereof.

4. The landing cushion of claim 1, wherein said back is inclined at an angle of between 22° to 32° from the vertical and said sides are inclined at an angle of between 19° to 29° from the vertical at the rear and 25° to 35° from the vertical at the front.

5. The landing cushion of claim 1, wherein, said back is inclined at an angle of approximately 27° from the vertical and said sides are inclined at an angle of 24° from the vertical at the rear and 30 ° from the vertical at the front.

* * * * *